US006144284A

United States Patent [19]

Santa Cruz et al.

[11] Patent Number: 6,144,284

[45] Date of Patent: Nov. 7, 2000

[54] BLOWN FUSE INDICATOR CAP AND METHOD OF USE

[76] Inventors: Cathy D. Santa Cruz, 7630 Tholl Dr., Reno, Nev. 89506; Galen J. May, 2251 Cielo Vista Dr., Sparks, Nev. 89436-9220

[21] Appl. No.: 09/327,441

[22] Filed: Jun. 7, 1999

[51] Int. Cl.[7] ..... H01H 85/30; H01H 85/32; F21Q 3/00

[52] U.S. Cl. ..... 337/242; 337/206; 337/271; 337/266; 324/507; 116/202

[58] Field of Search ..... 337/241, 242, 337/245, 265, 266, 206; 439/490, 491, 622; 324/507, 550, 691; 340/63, 81, 639; 361/835; 81/3, 8; 116/202

[56] References Cited

U.S. PATENT DOCUMENTS

| | | | |
|---|---|---|---|
| 988,891 | 4/1911 | Mitchell | 324/550 |
| 2,074,921 | 3/1937 | Kauffman | 337/242 |
| 2,157,777 | 5/1939 | Stoffel | 337/242 |
| 2,164,658 | 7/1939 | Lyon | 337/242 |
| 2,175,919 | 10/1939 | Schiller | 337/242 |
| 2,175,987 | 10/1939 | Dodge | 337/242 |
| 2,206,784 | 7/1940 | Linton | 337/242 |
| 2,492,302 | 12/1949 | Linton | 337/242 |
| 2,783,331 | 2/1957 | Sundt | 337/201 |
| 3,047,695 | 7/1962 | Borys | 337/206 |
| 3,659,252 | 4/1972 | Brown | 337/201 |
| 4,023,264 | 5/1977 | Schmidt, Jr. et al. | 29/623 |
| 4,475,283 | 10/1984 | Olson et al. | 29/720 |
| 4,511,875 | 4/1985 | Arikawa | 337/201 |
| 4,514,723 | 4/1985 | Leal | 340/638 |
| 4,906,963 | 3/1990 | Ackermann et al. | 337/244 |
| 5,002,505 | 3/1991 | Jones et al. | 439/622 |
| 5,552,757 | 9/1996 | Blecha et al. | 337/297 |
| 5,701,118 | 12/1997 | Hull et al. | 340/638 |

*Primary Examiner*—Leo P. Picard
*Assistant Examiner*—Anatoly Vortman

[57] ABSTRACT

A blown fuse indicator cap which is removably attachable to a pre-existing prior art cartridge type fuse housing, with the cap having indicator means thereon which notifies a user that the fuse has blown and needs replacing.

3 Claims, 1 Drawing Sheet

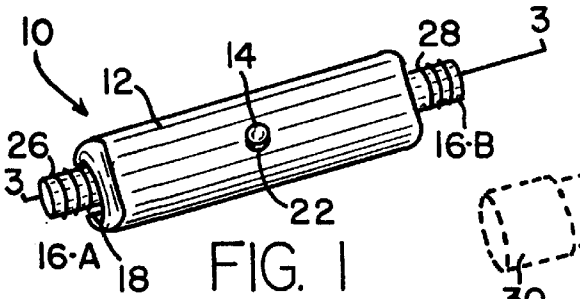
FIG. 1
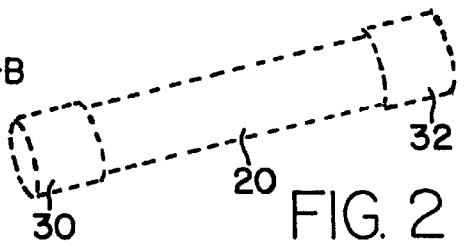
FIG. 2
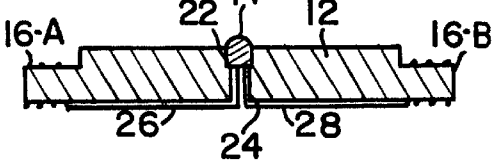
FIG. 3
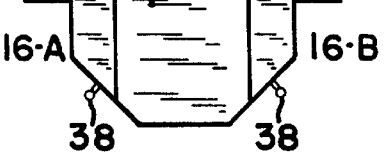
FIG. 4
FIG. 5
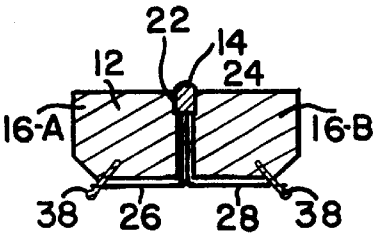
FIG. 6
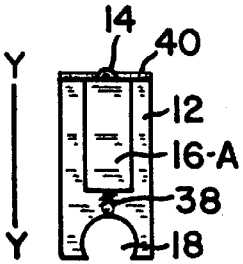
FIG. 7
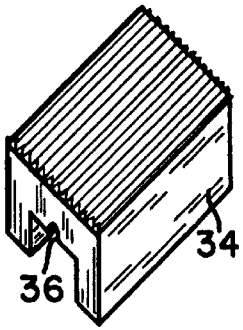
FIG. 8

BLOWN FUSE INDICATOR CAP AND METHOD OF USE

FIELD OF THE INVENTION

This invention relates to blown fuse indicators but more particularly pertains to a cap which is removably attachable to a prior art cartridge fuse housing, with the cap having indicator means which notifies a user that the fuse needs replacing.

BACKGROUND OF THE INVENTION

It is well known within the field that when a fuse has blown, it can be quite time consuming and difficult to locate the fuse, especially under circumstances during the night, or in the dark where no exterior lighting is provided. This situation is more often encountered such as when one is within a vehicle and the fuse block/box is positioned within the glove box or under the dash. In such a situation it can be extremely difficult and irritating when one is searching for the blown fuse which must be replaced and they simply can't see the fuses and/or the fuses are not easily accessible.

It is therefore contended by the applicants that an efficient, easily installed blown fuse indicator cap which includes indicator means, such as a light, a buzzer, etc., would be most advantageous and would eliminate guess work for the user, as well as save time and wasted energy.

The above noted situation has been addressed within the prior art and attempts have been made to resolve the problems associated therewith, but most attempts prove to be much to costly and to complicated for the average user to install, or they are simply inefficient.

The following are exemplary prior art references relating to blown fuse indicators such as found within the field of the present invention. U.S. Pat. No. 5,311,139 teaches a "FUSE CHECKER FOR TESTING INTEGRITY OF A MINIATURE, PLUG-IN FUSE WHILE THE FUSE IS INSTALLED IN AN ELECTRICAL CIRCUIT". This reference is functional for its intended purpose which is to "test" the condition of a fuse. The test is performed by using a checker which includes a housing from which extends a pair of parallel contact points adapted for engagement with terminal tabs that lie within terminal access openings within a plug-in type fuse housing and in practice, the user must manually insert the checker and apply constant pressure upon the terminal tabs while the test is performed and if a fuse is blown, one of two LED's located on the checker housing will illuminate, and if the fuse is not blown, both LED's on the checker will illuminate. This checker device is not designed to be used and/or installed on a permanent basis and is only usable for performing the above described test. This reference is therefore limited in use and could not be installed on a permanent basis as can the present invention.

Various types of spring clips have been taught for securing a blown fuse light indicator to a cartridge fuse housing as indicated by U.S. Pat. Nos. 5,300,913 and 3,457,535. However, these references are much too complicated and include additional parts which the present invention eliminates.

Another example of a blown fuse indicator is taught within our previous U.S. Pat. No. 5,701,118. However, this device is only functional with plug-in type fuse housings and cannot be used with standard cartridge type fuse housings, as taught by the present invention. Although, it is to be understood the circuitry as taught within our prior patent is utilized within the present invention, so such circuitry is not claimed herein.

SUMMARY OF THE INVENTION

The present invention is substantially a blown fuse indicator cap which is removably attachable to an existing cartridge type fuse housing, while the fuse housing is engaged within an electrical circuit. Such as a circuit which is commonly found within most vehicle fuse block/boxes, with the circuit being energized by a power source, such as a battery. The blown fuse indicator cap includes thereon an indicator light, and/or a sound alarm, and further provides appropriate circuitry for illuminating the light, and/or for causing a buzzer to sound an alarm.

It is therefore a primary object of the present invention to provide a blown fuse indicator cap which is removably attachable to an existing prior art standard type cartridge fuse housing when the fuse is installed in an electrical circuit.

It is another object of the present invention to provide a blown fuse indicator cap which includes means thereon for indicating when the fuse attached thereto has blown. Such as the cap may include a light source, or the cap may include a sound alarm, such as a buzzer, or the cap may include a combination of each.

It is another important object of the present invention to provide a blown fuse indicator cap which may be produced in a variety of colors which correspond to the various types of colored fuse housings, with the color of each representing and indicating amperage thereof. Or if preferred, the blown fuse indicator cap may include an accessory cover which is removable attached to the indicator, with the cover being of a color which indicates amperage of the fuse.

Still another object of the present invention is to provide a blown fuse indicator cap which includes appropriate circuitry for causing the unusual results of having an indicator light, and/or buzzer to be activated when the fuse has blown.

Yet another object of the present invention is to provide a blown fuse indicator cap which includes means to be slidably or frictionally retained on the cartridge type fuse housing.

A further object of the present invention is to provide a blown fuse indicator cap having means thereon to forcibly direct the lead lines from either the light, buzzer or both, to contact the ferrules located on the cartridge type fuse housing to complete electrical circuit.

Also another object of the present invention is to provide a blown fuse indicator cap which may be manufactured and sold as an accessory item for cartridge type fuses. Or if preferred, the indicator cap may be sold in combination with the cartridge type fuses as a complete unit.

A further object of the present invention is to provide a blown fuse indicator cap which may be sold as a preassembled unit. Or if preferred, the cap may be sold unassembled and the buyer would manually attach the indicator and lead lines to the cap after purchase.

Yet another object of the present invention is to provide a method for installing a blown fuse indicator with instructions for the user.

Other objects and advantages will be seen when taken into consideration with the following drawings and specification.

BRIEF DESCRIPTION OF THE DRAWINGS

FIG. 1 is substantially a perspective view of the present invention and illustrates one embodiment.

FIG. 2 is substantially a perspective view of a prior art cartridge type fuse housing.

FIG. 3 is substantially a sectional view of the present invention taken at 3—3 of FIG. 1.

FIG. 4 is substantially an end view of FIG. 1 showing the indicator cap when attached to a cartridge type fuse housing.

FIG. 5 is substantially a front view of a second embodiment for the present invention.

FIG. 6 is substantially a sectional view taken at 6—6 of FIG. 5.

FIG. 7 is substantially an end view of FIG. 5.

FIG. 8 is substantially a perspective view of a cover.

DETAILED DESCRIPTION OF THE DRAWINGS

Referring now in detail to the drawings wherein like numerals represent like elements throughout the various views. In FIG. 1, arrow (10) represents substantially an overview of one embodiment for the present invention. Wherein we show a blown fuse indicator cap arrow (10) comprising of a main body (12), having indicator means (14) therein for indicating when a fuse has blown, such as a light source or a buzzer, or any other suitable indicator means of engineering choice, and first and second electrical lead supports (16-A) and (16-B). With electrical lead supports (16-A) and (16-B) being substantially spaced apart and opposed to one another.

It is to be understood that main body (12) can be made from substantially any suitable material of engineering choice. Such as main body (12) can be integrally formed from a plastic injection mold, or the like, and may be of any suitable shape or size of engineering choice.

For example, in FIGS. 1, 3 & 4, main body (12) is integrally formed into substantially an elongated member having a partial circular cavity (18) therein. With circular cavity (18) being of a shape and size to mate and frictionally slidably receive the central portion of a pre-existing prior art cartridge type fuse housing (20) therein, respectively. With cartridge type fuse housing (20) having a first ferrule (30), a second ferrule (32) and a fuse (not shown).

Main body (12) includes a first recess (22) which is of a shape and size to frictionally retain indicator (14) therein, or any other suitable attachment means of engineering choice may be used to secure indicator (14) within first recess (22), such as with glue or the like.

Main body (12) further includes a second recess (24) which is in open communication with both circular cavity (18) and first recess (22), with second recess (24) being of a size substantially smaller than first recess (22).

Indicator (14) having a first electrical lead (26) and a second electrical lead (28). Second recess (24) being of a shape and size to threadably receive first electrical lead (26) and second lead line (28) there through, respectively. First electrical lead (26) being of a sufficient length to extend from indicator (14) into second recess (24), into circular cavity (18) and attached to first electrical lead support (16-A). Second electrical lead (28) being of a sufficient length to extend from indicator (14) into second recess (24), into circular cavity (18) and attached to second electrical lead support (16-B). It is to be understood that each electrical lead (26 & 28) may be attached to its corresponding electrical lead support (16-A) or (16-B) by any suitable attachment means of engineering choice, such as by soldering, or the like. Or if preferred, in FIGS. 1, 3 & 4 we show each electrical lead (26 & 28) being attached to its corresponding electrical lead support (16-A) or (16-B) by simply manually wrapping a portion of electrical lead (26 or 28) around its corresponding electrical lead support (16-A) or (16-B).

It will now be seen when main body (12) is manually snapped onto pre-existing cartridge type fuse housing (20), the wrapped portion of electrical lead (26) is urged against first ferrule (30), and the wrapped portion of electrical lead (28) is urged against second ferrule (32). Whereby: when indicator cap arrow (10) and cartridge type fuse housing (20) are combined and installed within a typical fuse block, the electrical circuit functions in the usual manner when the fuse contained within the cartridge type fuse housing is intact, but when the fuse blows disrupting the electrical circuit, indicator (14) is automatically activated and notifies a user the fuse is in need of replacement.

It is to be understood that indicator cap arrow (10) can be made from substantially any suitable material of choice. However, it is most advantageous if the main body (12) is formed from a translucent plastic which is of a color indicating amperage. However, if main body (12) is not formed from a colored plastic, an accessory cover (34) may be provided which is made from translucent colored plastic which is indicative and corresponds to the amperage of the fuse. Such as taught and illustrated within FIG. 8, wherein we show a cover (34) which is of a shape and size to be slidably removably engaged on top of the present indicator cap arrow (10). With cover (34) having an elongated recess (36) for slidably receiving indicator (14) therein, respectively. Whereby, when cover (34) is attached to indicator cap arrow (10), a user can visually determine the amperage of the fuse, (not shown). It is to be understood that FIG. 8 is only exemplary of one embodiment for cover (34) and any other embodiment or suitable attachment means of engineering choice may be used.

Another means to identify amperage of the pre-existing fuse (not shown) is taught within FIG. 7. Wherein, main body (12) includes an adhesively attached translucent strip of material (40), which is of a color that corresponds to amperage of the fuse (not shown). Whereby, when the strip of material (40) is attached to indicator cap arrow (10), a user can visually determine the amperage of the fuse. Also if desired, colored strip of material (40) may be serrated so as to provide an improved gripping surface, for easy assembly and installation.

Referring now to FIGS. 5–7 wherein we show the preferred embodiment for the present invention. It is to be understood that the embodiment as taught within FIGS. 1–4 is exactly the same in function, but the preferred embodiment is much more esthetically pleasing and is of a size and shape to be easily grasped by the user.

The preferred embodiment differs from the previously described embodiment as follows: The main body (12) as depicted in FIG. 7 has an overall height along its Y—Y axis which is longer than the overall height of the embodiment depicted in FIG. 4 along its Y—Y axis. This increased height is very advantageous as it provides a grip, thus allowing easy assembly and installation of indicator cap arrow (10). It is to be noted that if desired the portion which forms the grip may be serrated. Furthermore in the preferred embodiment, electrical lead support (16-A) and (16-B) include different attachment means for attaching first electrical lead (26) to electrical lead support (16-A), and second electrical lead (28) to electrical lead support (16-B). Such as illustrated in FIGS. 5–7, wherein electrical lead support (16-A) includes an embedded support structure (38) which is of a shape and size to allow first electrical lead (26) to be manually wrapped thereon, and electrical lead support (16-B) includes an embedded support structure (38) which is of a shape and size to allow second electrical lead (26) to be manually wrapped thereon.

It is to be understood any suitable support structure having a head thereon of engineering choice may be used, such as a screw, a nail, pin, etc. Also, each embedded support structure (38) may be embedded within its corresponding electrical lead support (16-A) or (16-B) by any suitable means of engineering choice, such as by threads, glue, etc.

It is to be noted, indicator means (14) can be positioned substantially anywhere within first recess (22) of engineering choice. For example, we have herein shown indicator (14) being positioned so as to protrude slightly from main body (12). However, even if indicator does not protrude as described, and is completely inserted into first recess (22), the indicator (14) is still completely functional, because if the indicator (14) is a light, it will illuminate through main body (12). Or if the indicator is a buzzer, the user can easily hear it when activated.

The present invention includes a method of use comprising of the following steps:

a. attaching an indicator cap, arrow (10) onto a pre-existing cartridge type fuse housing (20); and;

b. inserting pre-existing cartridge type fuse housing (20) with attached indicator cap arrow (10) into a typical fuse block, whereby:

when the fuse is operational, indicator (14) is not activated, but when the fuse has blown, indicator (14) is activated and notifies the user that the fuse must be replaced.

It will now be seen that we have herein provided a blown fuse indicator cap which is removably attached to an existing prior art cartridge type fuse housing when the fuse is installed in an electrical circuit.

It will further be seen that we have herein provided a blown fuse indicator cap which can be integrally formed and assembled at the point of manufacture. Or if preferred, the cap can be sold unassembled, and the user can assemble the cap after purchase.

It will also be seen that we have herein provided a blown fuse indicator cap which can be manufactured in a variety of colors which correspond to the various types of colored fuse housings, with the color of each representing and indicating amperage thereof.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and or apparatuses.

Having described our invention, what we claim as new and desire to secure by LETTERS PATENT is:

1. A blown fuse indicator cap comprising: a main body having indicator means for indicating when a fuse has blown, said main body having first and second electrical lead supports which are spaced apart and opposed to one another, said main body being an elongated member having a partial circular cavity which is of a shape and size to mate and receive a pre-existing prior art cartridge type fuse housing therein, said main body having a first recess which is of a shape and size to frictionally retain said indicator therein, said main body having a second recess which is in open communication with both said circular cavity and said first recess, with said second recess being of a size smaller than said first recess, said indicator having a first electrical lead and a second electrical lead, said second recess being of a shape and size to threadably receive said first electrical lead and said second electrical lead there through, said first electrical lead being of a sufficient length to extend from said indicator into said second recess into said circular cavity and be attached to said first electrical lead support, and said second electrical lead being of a sufficient length to extend from said indicator into said second recess into said circular cavity and be attached to said second electrical lead support.

2. A blown fuse indicator cap comprising: a main body having indicator means for indicating when a fuse has blown, said main body having first and second electrical lead supports which are spaced apart and opposed to one another, said main body being an elongated member having a partial circular cavity which is of a shape and size to mate and receive a pre-existing prior art cartridge type fuse housing therein, and said blown fuse indicator cap having an accessory cover which is of a shape and size to be slidably removably engaged on said indicator cap, with said cover being made from translucent colored plastic which is indicative and corresponds to the amperage of said fuse, whereby:

when said cover is attached to said indicator cap, a user can visually determine the amperage of said fuse.

3. A blown fuse indicator cap comprising: a main body having indicator means for indicating when a fuse has blown, said main body having first and second electrical lead supports which are spaced apart and opposed to one another, said main body being an elongated member having a partial circular cavity which is of a shape and size to mate and receive a pre-existing prior art cartridge type fuse housing therein, said blown fuse indicator cap having an adhesively attached translucent strip of material which is of a color that corresponds to the amperage of said fuse, and said strip of material being serrated so as to provide an improved gripping surface for easy assembly and installation, whereby:

when said strip of material is attached to said indicator cap, a user can visually determine the amperage of said fuse.

* * * * *